US010729944B2

(12) United States Patent
Motokawa

(10) Patent No.: US 10,729,944 B2
(45) Date of Patent: Aug. 4, 2020

(54) WOOD GOLF CLUB WITH CURVED WEIGHT INSIDE HOLLOW BODY

(71) Applicant: DUNLOP SPORTS CO. LTD., Kobe-shi, Hyogo (JP)

(72) Inventor: Yuki Motokawa, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 197 days.

(21) Appl. No.: 14/796,037

(22) Filed: Jul. 10, 2015

(65) Prior Publication Data

US 2016/0008679 A1 Jan. 14, 2016

(30) Foreign Application Priority Data

Jul. 11, 2014 (JP) ..... 2014-142866

(51) Int. Cl.
*A63B 53/04* (2015.01)

(52) U.S. Cl.
CPC .. *A63B 53/0466* (2013.01); *A63B 2053/0408* (2013.01)

(58) Field of Classification Search
CPC ..... A63B 53/0466; A63B 2053/045; A63B 53/00
USPC ..... 473/332, 346, 349
See application file for complete search history.

(56) References Cited

U.S. PATENT DOCUMENTS 3,695,618 A * 10/1972 Woolley ..... A63B 53/04 273/DIG. 1
4,681,322 A * 7/1987 Straza ..... A63B 53/04 273/DIG. 3
4,801,146 A * 1/1989 Honma ..... A63B 53/04 264/510
5,333,861 A * 8/1994 Mills ..... A63B 53/04 273/DIG. 22

(Continued)

FOREIGN PATENT DOCUMENTS

JP 2003-275345 A 9/2003
JP 2008-136861 A 6/2008
JP 2010-099408 A 5/2010

OTHER PUBLICATIONS

Office Action issued in Japanese Patent Application No. 2014-142866 dated Aug. 28, 2018.

(Continued)

*Primary Examiner* — William M Pierce
(74) *Attorney, Agent, or Firm* — Birch, Stewart, Kolasch & Birch LLP

(57) ABSTRACT

A wood golf club head is provided. The wood golf club head includes a hollow structure body having a face surface for hitting a ball. The hollow structure body has an inner surface and a thick portion in a predetermined region on the inner surface excluding a rear surface of the face surface. The thick portion is located outward of a virtual curved surface and has an outer surface extending along the virtual curved surface. The virtual curved surface is (a) a curved surface centered about a predetermined reference point located inside the hollow structure body or (b) a curved surface having a central axis that is a straight line passing through a reference point located inside the hollow structure body.

13 Claims, 11 Drawing Sheets

(56) References Cited

U.S. PATENT DOCUMENTS 5,674,132 A * 10/1997 Fisher ..... A63B 53/04 273/DIG. 8
5,720,674 A * 2/1998 Galy ..... A63B 53/04 473/334
5,921,871 A * 7/1999 Fisher ..... A63B 53/04 473/329
6,306,048 B1 * 10/2001 McCabe ..... A63B 53/04 473/333
6,602,149 B1 * 8/2003 Jacobson ..... A63B 53/04 473/329
6,939,247 B1 * 9/2005 Schweigert ..... A63B 53/0466 473/314
8,657,703 B2 * 2/2014 Wada ..... A63B 53/0466 473/335
8,926,448 B1 * 1/2015 Ivanova ..... A63B 53/047 473/329
9,022,880 B2 * 5/2015 Kawaguchi ..... A63B 53/047 473/329
9,033,818 B2 * 5/2015 Myrhum ..... A63B 53/0466 473/329
9,283,449 B1 * 3/2016 DeMille ..... A63B 53/0466
2002/0010034 A1 * 1/2002 Reyes ..... A63B 53/02 473/345
2002/0022535 A1 * 2/2002 Takeda ..... A63B 53/04 473/346
2002/0045491 A1 * 4/2002 Reyes ..... A63B 53/04 473/345
2002/0094884 A1 * 7/2002 Hocknell ..... A63B 53/02 473/334
2002/0183136 A1 * 12/2002 Helmstetter ..... A63B 53/04 473/345
2005/0059508 A1 * 3/2005 Burnett ..... A63B 53/0466 473/349
2006/0073907 A1 * 4/2006 Murphy ..... A63B 53/0466 473/329
2006/0116218 A1 * 6/2006 Burnett ..... A63B 53/0466 473/349
2006/0166758 A1 * 7/2006 Roberts ..... A63B 53/047 473/349
2006/0199661 A1 * 9/2006 Deng ..... A63B 53/047 473/324
2007/0010350 A1 * 1/2007 Murphy ..... A63B 53/0466 473/349
2007/0026967 A1 * 2/2007 Schweigert ..... A63B 53/047 473/349
2007/0078028 A1 * 4/2007 Huang ..... A63B 53/0466 473/324
2007/0178987 A1 * 8/2007 Wright ..... A63B 53/0487 473/329
2008/0039228 A1 * 2/2008 Breier ..... A63B 53/0466 473/334
2008/0113825 A1 5/2008 Funayama et al.
2010/0160075 A1 * 6/2010 Dawson ..... A63B 53/0466 473/349
2010/0323812 A1 * 12/2010 Boyd ..... A63B 53/0466 473/329
2011/0312437 A1 * 12/2011 Sargent ..... A63B 53/02 473/335
2013/0109503 A1 * 5/2013 Matsunaga ..... A63B 53/00 473/346
2014/0228142 A1 * 8/2014 Beno ..... A63B 60/42 473/223
2014/0357403 A1 * 12/2014 Quan ..... A63B 53/0487 473/349
2016/0067571 A1 * 3/2016 Curtis ..... A63B 59/0074 473/332

OTHER PUBLICATIONS

Japanese Office Action, dated Mar. 6, 2018, for Japanese Application No. 2014-142866, along with an English translation.

* cited by examiner

WOOD GOLF CLUB WITH CURVED WEIGHT INSIDE HOLLOW BODY

CROSS REFERENCE TO RELATED APPLICATIONS

This application claims a priority to Japanese Patent Application No. 2014-142866 filed on Jul. 11, 2014, which is hereby incorporated by reference in its entirety.

FIELD OF INVENTION

The present invention relates to a wood golf club head.

BACKGROUND

Various design targets are set when designing wood golf club heads. For example, JP 2010-99408A (hereinafter, called Patent Literature 1) discloses a wood golf club in which the vertical moment of inertia of the head can be increased while maintaining a low sweet spot height. More specifically, in Patent Literature 1, an oblong shape is circumscribed around a projected image of the head that is projected on a reference surface in the state in which the sole portion is placed on the reference surface with a given lie angle, and the oblong shape is divided into 3×3 equal oblong regions. Weight is distributed in the sole portion in units of the oblong regions. More specifically, the head is designed such that the weight in the oblong region in the center on the face side and the oblong region in the center on the back side is greater than the weight in the oblong region in the center on the toe side and the oblong region in the center on the heel side.

SUMMARY OF INVENTION

Normally, a design target value for the total weight of the golf club head is determined in advance, and in many cases, there is a limit on the surplus weight that can be distributed for increasing the moment of inertia of the head. For this reason, if weight is simply distributed in units of 3×3 oblong regions as in Patent Literature 1, it is quite conceivable to not be able to obtain a sufficient moment of inertia for the head with limited surplus weight.

An object of the present invention is to provide a wood golf club head having a large moment of inertia for the head.

A wood golf club head according to a first aspect of the present invention includes a hollow structure body having a face surface for hitting a ball. The hollow structure body has an inner surface and a thick portion in a predetermined region on the inner surface excluding a rear surface of the face surface. The thick portion is located outward of a virtual curved surface and has an outer surface extending along the virtual curved surface. The virtual curved surface is (a) a curved surface centered about a predetermined reference point located inside the hollow structure body or (b) a curved surface having a central axis that is a straight line passing through a reference point located inside the hollow structure body.

A wood golf club head according to a second aspect of the present invention is the golf club head according to the first aspect, wherein the virtual curved surface is a curved surface that extends along an outer surface of a virtual sphere or ellipsoid centered about the reference point, or a virtual cylinder, elliptical cylinder, cone, or elliptical cone having a central axis that is a straight line passing through the reference point.

A wood golf club head according to a third aspect of the present invention is the golf club head according to the first aspect or the second aspect, wherein the reference point is a point located in a range of 25.0 mm from a center of gravity of the golf club head.

A wood golf club head according to a fourth aspect of the present invention is the golf club head according to the third aspect, wherein the reference point is a point located in a range of 10.0 mm from the center of gravity.

A wood golf club head according to a fifth aspect of the present invention is the golf club head according to the fourth aspect, wherein the reference point is a point located in a range of 5.0 mm from the center of gravity.

A wood golf club head according to a sixth aspect of the present invention is the golf club head according to the fifth aspect, wherein the reference point is a point located in a range of 2.0 mm from the center of gravity.

A wood golf club head according to a seventh aspect of the present invention is the golf club head according to any of the first to sixth aspects, wherein the hollow structure body has a crown portion, a sole portion, and a side portion. The thick portion is provided on the sole portion.

A wood golf club head according to an eighth aspect of the present invention is the golf club head according to any of the first to seventh aspects, wherein the thick portion is located on a back side relative to a depth plane that is perpendicular to a horizontal plane, includes a center of gravity of the golf club head, and extends in a toe-heel direction.

A wood golf club head according to a ninth aspect of the present invention is the golf club head according to any of the first to eighth aspects, wherein the thick portion further has an outer surface that extends along the depth plane.

A wood golf club head according to a tenth aspect of the present invention is the golf club head according to any of the first to ninth aspects, wherein the thick portion is provided at at least a position on a toe side of the inner surface of the hollow structure body.

A wood golf club head according to an eleventh aspect of the present invention is the golf club head according to any of the first to tenth aspects, wherein the virtual curved surface is (a) a curved surface centered about a predetermined reference point located inside the hollow structure body.

A wood golf club head according to a twelfth aspect of the present invention is the golf club head according to any of the first to tenth aspects, wherein the virtual curved surface is (b) a curved surface having a central axis that is a straight line passing through a reference point located inside the hollow structure body.

According to the first aspect, the thick portion on the inner side (inner surface) of the hollow structure body of the golf club head is located outward of a virtual curved surface centered about a predetermined reference point in the hollow structure body or having a central axis that is a straight line passing through the reference point, and has an outer surface that extends along the virtual curved surface. As a result, a golf club head is provided in which weight is distributed in a balanced manner at positions distant from the predetermined reference point in the hollow structure body. Accordingly, weight can be distributed appropriately, and the moment of inertia of the head can be increased.

DETAILED DESCRIPTION OF THE PREFERRED EMBODIMENTS

Wood golf club heads according to several embodiments of the present invention will be described below with reference to the drawings.

1. Process Leading to Arrival at Following Embodiments

Before describing several embodiments of the present invention, the following describes the process that led the inventor of the present invention to arrive at the following embodiments.

Through careful examination carried out by the inventor of the present invention, it was found that in the design of a thick portion arranged inside a golf club head having a hollow structure (note: arranged in a region excluding the rear surface of the face surface), in order to increase the moment of inertia of the head, it is sufficient to omit the formation of a thick portion inward of a virtual curved surface centered about the center of gravity, and form a thick portion outward of this virtual curved surface. Distributing the weight in this way makes it possible to skew the weight obtained by the thick portion to a position separated as far as possible from the center of gravity. In other words, an increase in the moment of inertia of the head is achieved by concentrating the weight at a position distant from the center of gravity.

Note that simply from the viewpoint of increasing the moment of inertia of the head, it is desirable that a point serving as a reference for defining the center or the central axis of the virtual curved surface (hereinafter, called a reference point M) exactly matches the center of gravity. Of course, in reality, there are various design-related constraints in the design of the head (including the shape, weight, center of gravity position, appearance, and the like). Accordingly, although somewhat of a deviation of the reference point M from the center of gravity is envisioned, similar effects can be expected as long as the reference point M is located in the vicinity of the center of gravity.

2. First Embodiment

2-1. Overview of Golf Club Head

Figure 1:
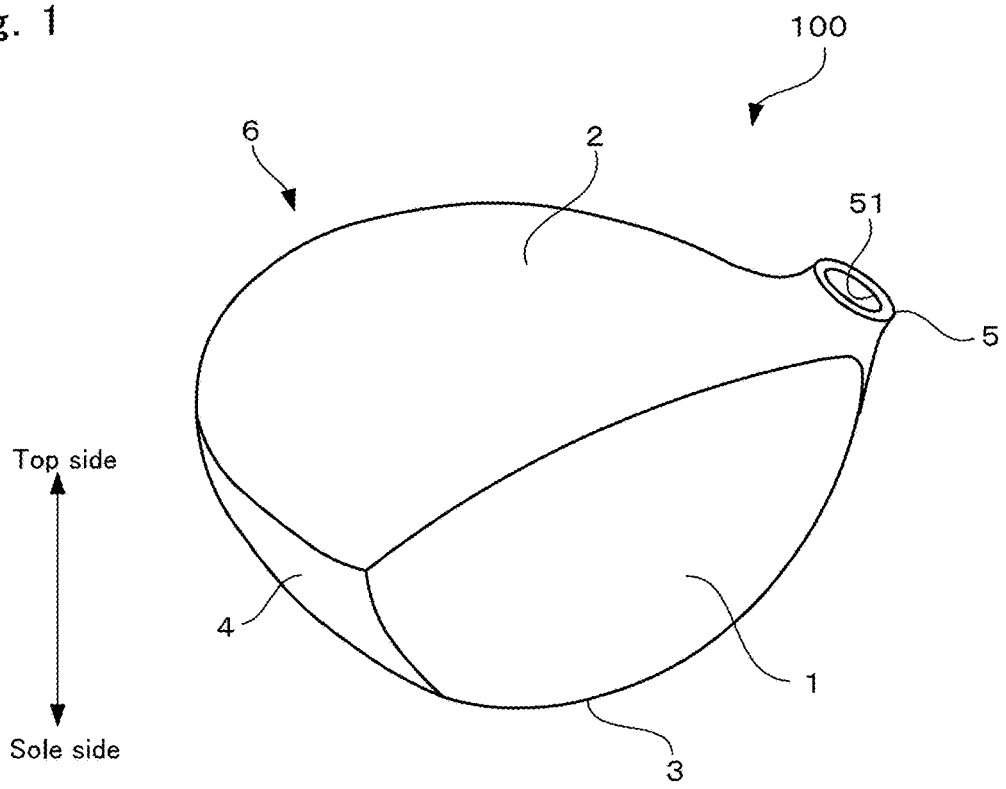
FIG. 1 is a perspective view of a golf club head in a reference state according to a first embodiment.
Figure 2:
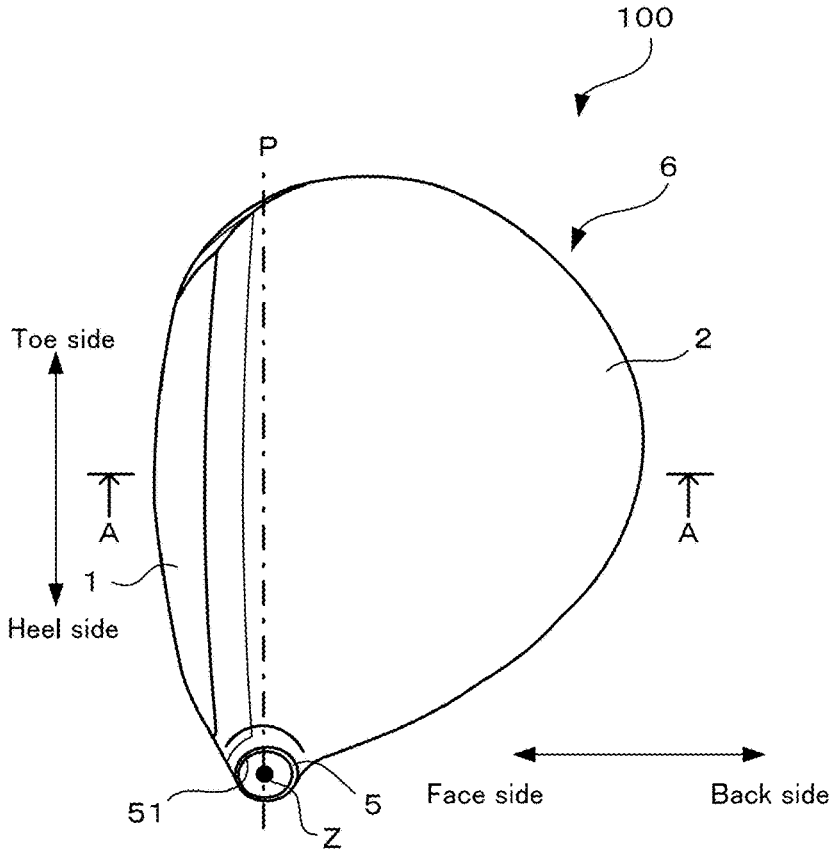
FIG. 2 is a plan view of the golf club head in the reference state according to the first embodiment.

FIG. 1 is a perspective view of a golf club head (hereinafter, sometimes simply called the "head") 100 of the present embodiment in a reference state, and FIG. 2 is a plan view of the head 100 in the reference state. The reference state of the golf club head 100 will be described later. The head 100 constitutes a hollow structure body, and this hollow structure body has wall surfaces formed by a face portion 1, a crown portion 2, a sole portion 3, a side portion 4, and a hosel portion 5. The head 100 is a wood-type head for a driver (#1) or fairway wood, for example.

The face portion 1 has a face surface for hitting a ball, and constitutes the front portion of the head 100. The face surface is approximately flat. The crown portion 2 is adjacent to the face portion 1, and constitutes the upper surface of the head 100. The sole portion 3 constitutes the bottom surface of the head 100, and is adjacent to the face portion 1 and the side portion 4. Also, the side portion 4 is the portion between the crown portion 2 and the sole portion 3, and is the portion that extends from the toe side of the face portion 1, across the back side of the head 100, and to the heel side of the face portion 1. Furthermore, the hosel portion 5 is the portion provided adjacent to the heel side of the crown portion 2, and has an insertion hole 51 for the insertion of the shaft (not shown) of the golf club.

The following describes the aforementioned reference state. As shown in FIGS. 1 and 2, the reference state is defined as a state in which a central axis Z of the insertion hole 51 is included in a plane P (hereinafter, called the reference vertical plane P) that is perpendicular to a horizontal plane H (see FIG. 3), and furthermore the head 100 is placed on the horizontal plane H with a predetermined lie angle and a hook angle of 0°. Also, as shown in FIG. 2, the direction of the line of intersection of the reference vertical plane P and the horizontal plane H will be referred to as the toe-heel direction, and the direction that is perpendicular to the toe-heel direction and parallel to the horizontal plane H will be referred to as the face-back direction. Also, the direction perpendicular to the horizontal plane H will be referred to as the top-sole direction. Also, unless otherwise indicated, the term "horizontal" used below may indicate the toe-heel direction. Also, the terms "vertical" and "height" used below will refer to the top-sole direction, and the term "height" in particular will refer to a dimension in which the sole side is low and the top side is high. Also, the term "depth" will refer to the face-back direction, and will refer to a dimension in which the face side is shallow and the back side is deep.

In the present embodiment, the boundary between the crown portion 2 and the side portion 4 can be defined as follows. Specifically, if a ridge line is formed between the crown portion 2 and the side portion 4, that ridge line serves as the boundary. On the other hand, if a clear ridge line is not formed, the boundary is the outline that is seen when the head 100 is placed in the reference state and viewed from directly above a center of gravity G of the head 100. The same follows in the case of the boundary between the sole portion 3 and the side portion 4 as well, and if a ridge line is formed, that ridge line serves as the boundary. On the other hand, if a clear ridge line is not formed, the boundary is the outline that is seen when the head 100 is placed in the reference state and viewed from directly below the center of gravity G of the head 100.

The volume of the head 100 is, for example, preferably 300 $cm^3$ or more, more preferably 400 $cm^3$ or more, and particularly preferably 420 $cm^3$ or more. The head 100 having such a volume is useful in increasing comfort when the club is held and also increasing the sweet spot area and the moment of inertia of the head. Note that although an upper limit is not particularly defined for the volume of the head 100, practically it is, for example, desirably 500 $cm^3$ or less, or desirably 470 $cm^3$ or less when complying with R&A or USGA rules and regulations.

The head 100 can be formed from a titanium alloy having a specific gravity of approximately 4.0 to 5.0, for example. Besides a titanium alloy, the head can be formed from one or two or more materials selected from among stainless steel, maraging steel, an aluminum alloy, a magnesium alloy, an amorphous alloy, and the like. Also, there is no limit to being a metal material, and the head can also be formed using a fiber-reinforced plastic or the like.

The head 100 of the present embodiment is constituted by assembling the face portion 1 to a head body 6 having the crown portion 2, the sole portion 3, the side portion 4, and the hosel portion 5. The head body 6 and the face portion 1 are joined to each other by welding or the like. The head body 6 is a hollow structure that has the crown portion 2, the sole portion 3, and the side portion 4 as outer walls and has an opening on the face portion 1 side, and the face portion 1 is attached so as to block this opening. The head body 6 and the face portion 1 that are described above can be manufactured using various methods. For example, the head body 6 can be manufactured by casting using a known lost-wax precision casting method or the like. Also, the face portion 1 can be manufactured using a forging method, for example. The structure of the face portion 1 will be described in detail below.

2-2. Thick-Wall Structure in Head Body

Figure 3:
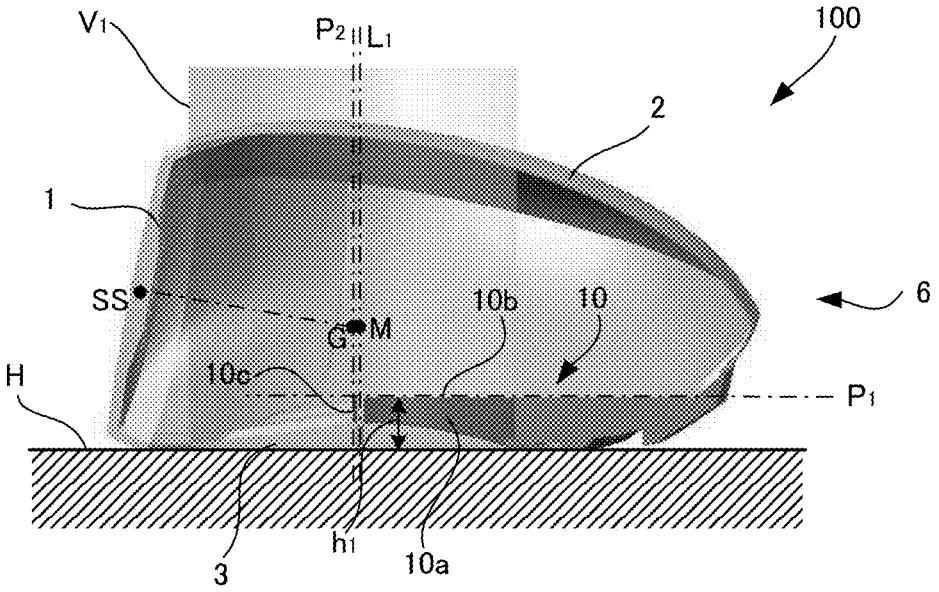
FIG. 3 is a cross-sectional view taken along A-A in FIG. 2.
Figure 4:
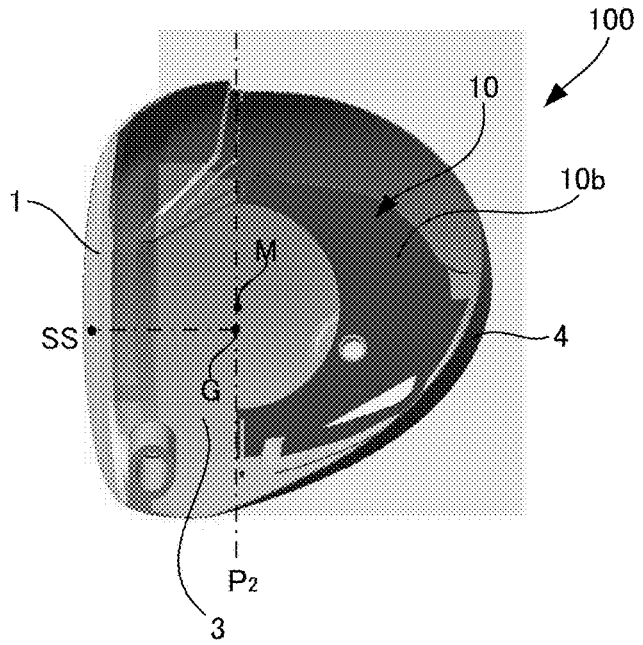
FIG. 4 is a diagram showing the golf club head according to the first embodiment with an upper portion removed, as viewed from above.
Figure 5:
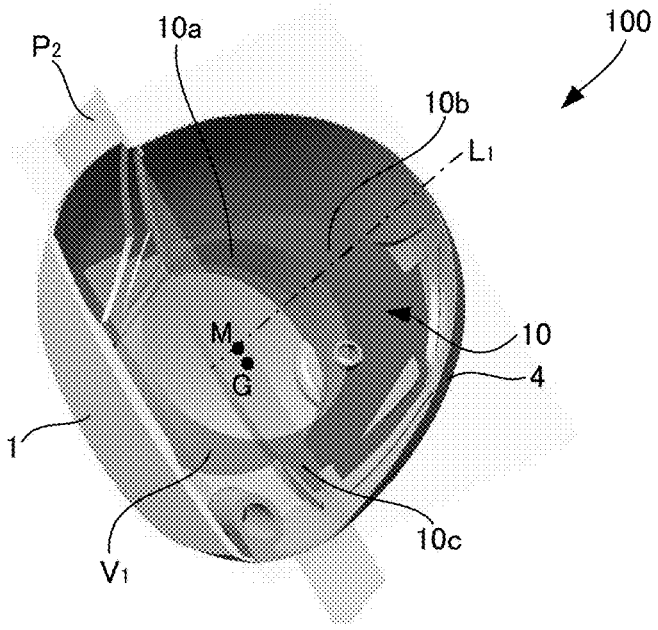
FIG. 5 is a diagram showing the golf club head according to the first embodiment with the upper portion removed, as viewed from obliquely above.

The following describes the thick-wall structure in the head body 6 with reference to FIGS. 3 to 5 as well. FIG. 3 is a cross-sectional view along A-A in FIG. 2, and FIG. 4 is a diagram showing the head 100 as viewed from above, with the upper portion removed in order to view the thick-wall structure in the head body 6. FIG. 5 is a diagram of the head 100 in FIG. 4, as viewed from obliquely above. An innovation has been made to the thick-wall structure in the head body 6 in order to maximize the moment of inertia of the head around the center of gravity G of the head 100. The first embodiment maximizes the moment of inertia of the head in the horizontal direction (hereinafter, simply called the horizontal moment of inertia), which is the moment around an axis that is perpendicular to the horizontal plane H and passes through the center of gravity G. The thick-wall structure of the head body 6 has a thick portion. The thick portion is the portion where material corresponding to surplus weight is arranged inward of the outline of the thin portion of the head body 6 having an approximately uniform thickness. For example, the thick portion can be defined as the portion that is thicker than the average thickness of the head body 6.

Specifically, in the present embodiment, a thick portion 10 is formed on the sole portion 3 in the head body 6, as shown in FIG. 3. As shown in FIG. 4, this thick portion 10 extends outward of a semicircular arc centered about the reference point M in a plan view. The reference point M is a point located in the vicinity of the center of gravity G in the head 100. Also, as shown in FIG. 5, the thick portion 10 has a side surface 10*a* (outer surface) that extends along a virtual curved surface that constitutes part of the outer surface of a virtual cylinder $V_1$ in a three-dimensional view, and the thick portion 10 is located outward of the virtual cylinder $V_1$. The virtual cylinder $V_1$ is a cylinder having a central axis $L_1$ that is a straight line passing through the reference point M, and the central axis $L_1$ extends in the top-sole direction. The reference point M and the center of gravity G are at the same position in the top-sole direction.

Note that a sweet spot SS is shown in FIG. 3 for reference. The same follows in other diagrams as well. Note that the sweet spot SS is the intersection of the face portion 1 and the line that passes through the center of gravity G and is perpendicular to the face portion 1.

In the present embodiment, the thick portion 10 has a constant height $h_1$, and an upper surface 10*b* of the thick portion 10 that defines the height $h_1$ is flat. In other words, the thick portion 10 has the upper surface 10*b* (outer surface) that is located on the sole side of a base plane $P_1$ (see FIG. 3) that is parallel to the plane H and is located at the height $h_1$ position, and the upper surface 10*b* extends along the base plane $P_1$. Note that the height $h_1$ can be set differently according to the location, in accordance with the design target value of the height of the center of gravity. Also, it is preferable that the thick portion 10 is located at a position lower than the center of gravity G if a reduction in the height of the center of gravity is a target.

Here, for the sake of convenience in the description, a depth plane $P_2$ is defined as the plane that includes the center of gravity G, extends in the toe-heel direction, and is perpendicular to the plane H (see FIGS. 3 and 5). The depth plane $P_2$ defines the face-side end surface of the thick portion 10. In other words, the thick portion 10 has a side surface 10*c* (outer surface) that is located on the back side relative to the depth plane $P_2$ and extends along the depth plane $P_2$. An increase in the depth of the center of gravity is thus achieved. Note that in accordance with the design target value of the depth of the center of gravity, the thick portion 10 may be arranged on the face side relative to the center of gravity G, or may be arranged on both the face side and the back side. In this case, the thick portion 10 can be a portion that extends in the shape of a ring rather than a semicircle, in a plan view.

The reference point M that determines the position of the aforementioned virtual cylinder $V_1$ is preferably located in a range of 25.0 mm from the center of gravity G, and more preferably is located in a range of 10.0 mm from the center of gravity G. Also, the reference point M is more preferably located in a range of 7.0 mm from the center of gravity G, further preferably located in a range of 5.0 mm from the center of gravity G, further preferably located in a range of 2.0 mm from the center of gravity G, further preferably located in a range of 1.0 mm from the center of gravity G, and further preferably located in a range of 0.5 mm from the center of gravity G. In particular, the deviation between the reference point M and the center of gravity G in the face-back direction is preferably 2.0 mm or less, and more preferably 1.0 mm or less. The smaller the distance between the reference point M and the center of gravity G is, the more uniformly the thick portion 10, which is arranged centered about the reference point M, is arranged around the center of gravity G, and the greater the expected increase in the horizontal moment of inertia is.

As described above, in the present embodiment, the thick portion 10 on the inner side of the head body 6 is configured to be located outward of the virtual cylinder $V_1$ and have an outer surface that extends along the virtual cylinder $V_1$. As a result, the weight is distributed in a balanced manner at positions distant from the central axis $L_1$ that passes through the reference point M in the vicinity of the center of gravity G and extends in the vertical direction, and it is possible to increase the horizontal moment of inertia of the head 100.

3. Second Embodiment

A golf club head 200 according to a second embodiment will be described below with reference to FIGS. 6 to 8. The head 200 has a configuration similar to that of the head 100 of the first embodiment, with the exception of a difference in the thick-wall structure in the head 200, and the following description focuses on differences that the head 200 has from the head 100. Also, constituent elements common with the first embodiment will be denoted by the same reference signs and will not be described.

Figure 6:
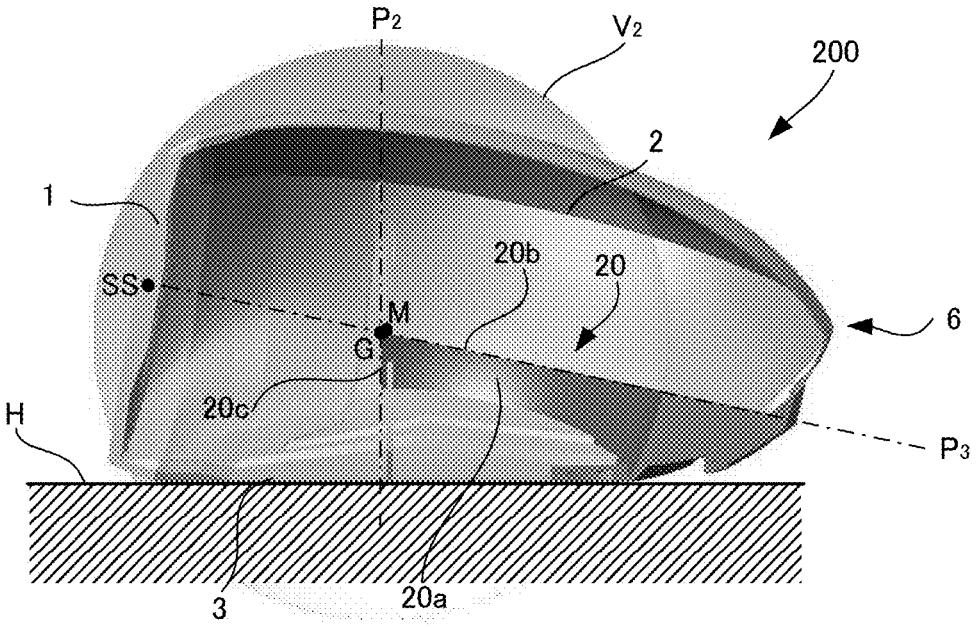
FIG. 6 is a lateral cross-sectional view of a golf club head according to a second embodiment.
Figure 7:
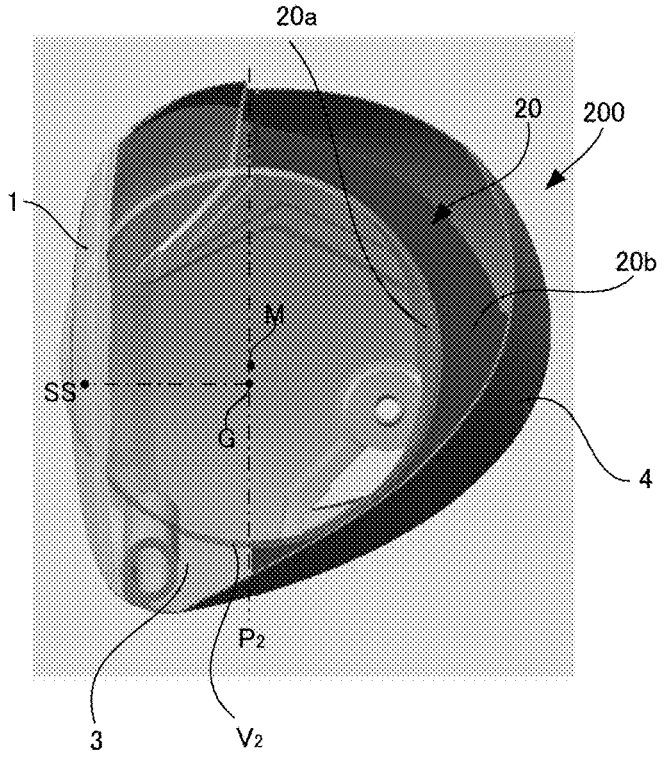
FIG. 7 is a diagram showing the golf club head according to the second embodiment with an upper portion removed, as viewed from above.
Figure 8:
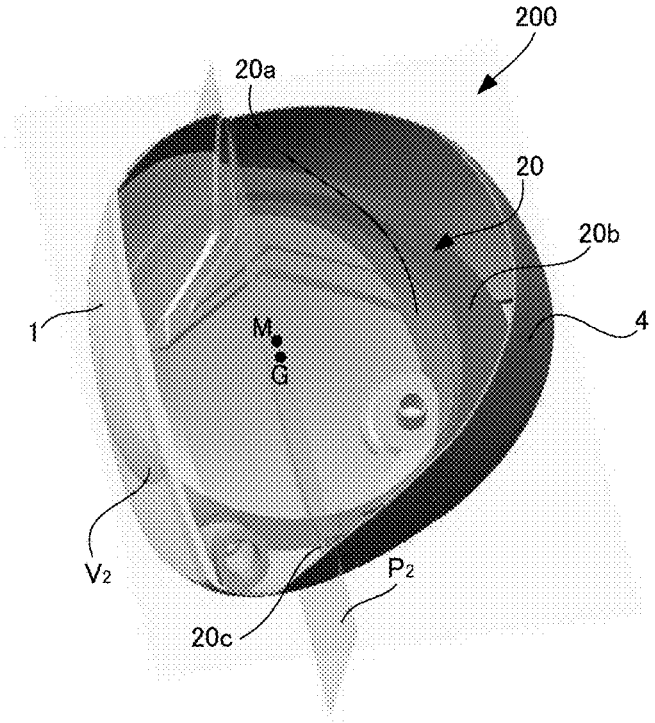
FIG. 8 is a diagram showing the golf club head according to the second embodiment with the upper portion removed, as viewed from obliquely above.

FIG. 6 is a lateral cross-sectional view of the head 200, and FIG. 7 is a diagram showing the head 200 as viewed from above, with the upper portion removed in order to view the thick-wall structure in the head body 6. FIG. 8 is a diagram of the head 200 in FIG. 7, as viewed from obliquely above. In the second embodiment, the moment of inertia with respect to various directions around the center of gravity G of the head 200 is optimized using the thick-wall structure in the head body 6.

Specifically, in the second embodiment as well, a thick portion 20 is formed on the sole portion 3 in the head body 6, as shown in FIG. 6. As shown in FIG. 7, this thick portion 20 extends outward of a semicircular arc centered about the reference point M in a plan view. The reference point M is a point located in the vicinity of the center of gravity G in the head 100. Also, as shown in FIG. 8, the thick portion 20 has a side surface 20*a* (outer surface) that extends along a virtual curved surface that constitutes part of the outer surface of a virtual sphere $V_2$ in a three-dimensional view, and the thick portion 20 is located outward of the virtual sphere $V_2$. The virtual sphere $V_2$ is a sphere centered about the reference point M.

In the second embodiment as well, an upper surface 20*b* of the thick portion 20 is flat. Note that a height $h_2$ thereof is not constant, and the thick portion 20 of the present embodiment has the upper surface 20*b* (outer surface) that is located on the sole side of a base plane $P_3$ (see FIG. 6) that passes through the center of gravity G and is inclined in the vertical direction, and the upper surface 20*b* extends along the base plane $P_3$. However, it is also possible to set the height $h_2$ constant regardless of the location, and it is possible for the base plane $P_3$ to be a plane that does not pass through the center of gravity G. Also, similarly to the first embodiment, the face-side end surface of the thick portion 20 as well is defined by the depth plane $P_2$. In other words, the thick portion 20 has a side surface 20*c* (outer surface) that is located on the back side relative to the depth plane $P_2$ and extends along the depth plane $P_2$. An increase in the depth of the center of gravity is thus achieved. Note that in accordance with the design target value of the depth of the center of gravity, the thick portion 20 may be arranged on the face side relative to the center of gravity G, or may be arranged on both the face side and the back side.

The reference point M that serves as the center of the aforementioned virtual sphere $V_2$ is preferably located in a range of 25.0 mm from the center of gravity G, and more preferably is located in a range of 10.0 mm from the center of gravity G. Also, the reference point M is more preferably located in a range of 7.0 mm from the center of gravity G, further preferably located in a range of 5.0 mm from the center of gravity G, further preferably located in a range of 2.0 mm from the center of gravity G, further preferably located in a range of 1.0 mm from the center of gravity G, and further preferably located in a range of 0.5 mm from the center of gravity G. In particular, the deviation between the reference point M and the center of gravity G in the top-sole direction is preferably 2.0 mm or less, and more preferably 1.0 mm or less. Also, the deviation between the reference point M and the center of gravity G in the face-back direction is preferably 2.0 mm or less, and more preferably 1.0 mm or less. The smaller the distance between the reference point M and the center of gravity G is, the more uniformly the thick portion 20, which is arranged centered about the reference point M, is arranged around the center of gravity G, and the greater the expected increase in the moment of inertia in various directions around the center of gravity G is.

As described above, in the present embodiment, the thick portion 20 on the inner side of the head body 6 is configured to be located outward of the virtual sphere $V_2$ and have an outer surface that extends along the virtual sphere $V_2$. As a result, the weight is distributed in a balanced manner at positions distant from the reference point M in the vicinity of the center of gravity G, and it is possible to increase the moment of inertia in various directions around the center of gravity G.

4. Third Embodiment

A golf club head 300 according to a third embodiment will be described below with reference to FIGS. 9 to 11. The head 300 has a configuration similar to that of the head 100 of the first embodiment, with the exception of a difference in the thick-wall structure in the head 300, and the following description focuses on differences that the head 300 has from the head 100. Also, constituent elements common with the first embodiment will be denoted by the same reference signs and will not be described.

Figure 9:
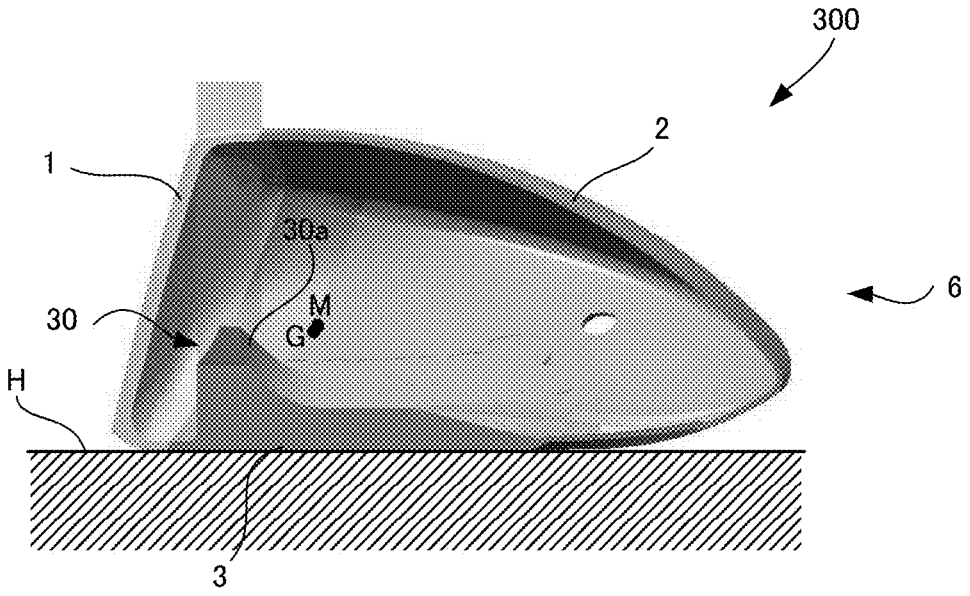
FIG. 9 is a lateral cross-sectional view of a golf club head according to a third embodiment.
Figure 10:
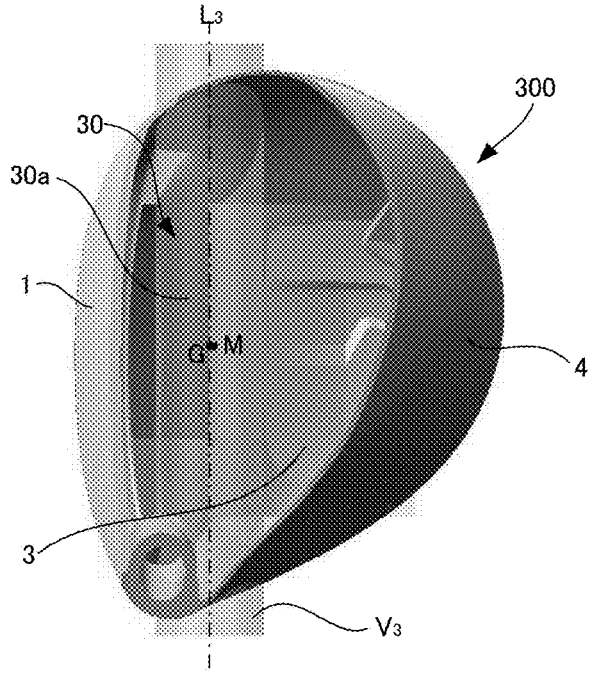
FIG. 10 is a diagram showing the golf club head according to the third embodiment with an upper portion removed, as viewed from above.
Figure 11:
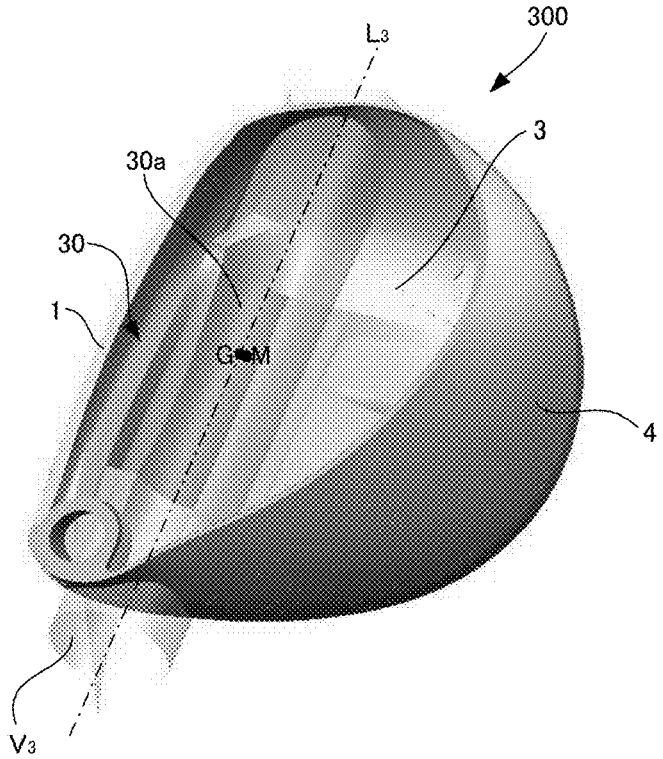
FIG. 11 is a diagram showing the golf club head according to the third embodiment with the upper portion removed, as viewed from obliquely above.

FIG. 9 is a lateral cross-sectional view of the head 300, and FIG. 10 is a diagram showing the head 300 as viewed from above, with the upper portion removed in order to view the thick-wall structure in the head body 6. FIG. 11 is a diagram of the head 300 in FIG. 10, as viewed from obliquely above. In the third embodiment, the moment of inertia of the head in the vertical direction (hereinafter, simply called the vertical moment of inertia) around the center of gravity G of the head 300 is optimized using the thick-wall structure in the head body 6.

Specifically, in the third embodiment as well, a thick portion 30 is formed on the sole portion 3 in the head body 6, as shown in FIG. 9. As shown in FIG. 10, this thick portion 30 extends in a straight line in a plan view. Also, as shown in FIG. 11, the thick portion 30 has a side surface 30*a* (outer surface) that extends along a virtual curved surface that constitutes part of the outer surface of a virtual cylinder $V_3$ in a three-dimensional view, and the thick portion 30 is located outward of the virtual cylinder $V_3$. The virtual cylinder $V_3$ is a cylinder having a central axis $L_3$ that is a straight line passing through the reference point M, and the central axis $L_3$ extends in the toe-heel direction. The thick portion 30 is located on the face side relative to the center of gravity G, and thus a reduction in the depth of the center of gravity is achieved. Note that in accordance with the design target value of the depth of the center of gravity, the thick portion 30 may be arranged on the back side relative to the center of gravity G, or may be arranged on both the face side and the back side. The reference point M and the center of gravity G are at the same position in the toe-heel direction.

Since it is desirable to design the reference point M that determines the position of the aforementioned virtual cylinder $V_3$ so as to match the center of gravity G, the reference point M is preferably located in a range of 2.0 mm from the center of gravity G, preferably located in a range of 1.0 mm from the center of gravity G, and more preferably located in a range of 0.5 mm from the center of gravity G. In particular, the deviation between the reference point M and the center of gravity G in the top-sole direction is preferably 1.0 mm or less. The smaller the distance between the reference point M and the center of gravity G is, the more uniformly the thick portion 30, which is arranged centered about the reference point M, is arranged around the center of gravity G, and the greater the expected increase in the vertical moment of inertia is.

As described above, in the present embodiment, the thick portion 30 on the inner side of the head body 6 is configured to be located outward of the virtual cylinder $V_3$ and have an outer surface that extends along the virtual cylinder $V_3$. As a result, the weight is distributed in a balanced manner at positions distant from the central axis $L_3$ that passes through the reference point M in the vicinity of the center of gravity G and extends in the horizontal direction, and it is possible to increase the vertical moment of inertia of the head 300.

5. Fourth Embodiment

A golf club head 400 according to a fourth embodiment will be described below with reference to FIGS. 12 to 14. The head 400 has a configuration similar to that of the head 100 of the first embodiment, with the exception of a difference in the thick-wall structure in the head 400, and the following description focuses on differences that the head 400 has from the head 100. Also, constituent elements common with the first embodiment will be denoted by the same reference signs and will not be described.

Figure 12:
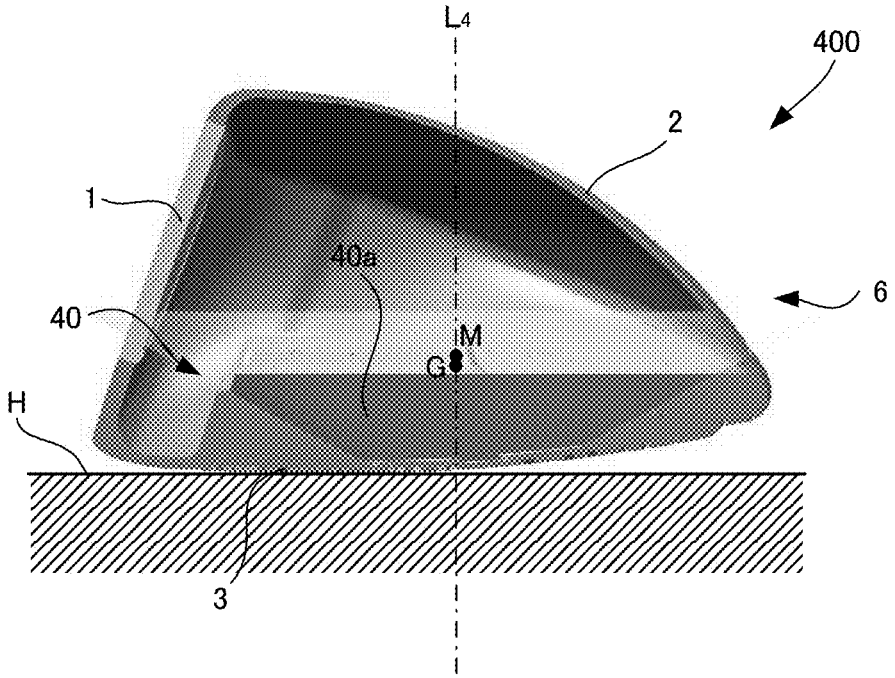
FIG. 12 is a lateral cross-sectional view of a golf club head according to a fourth embodiment.
Figure 13:
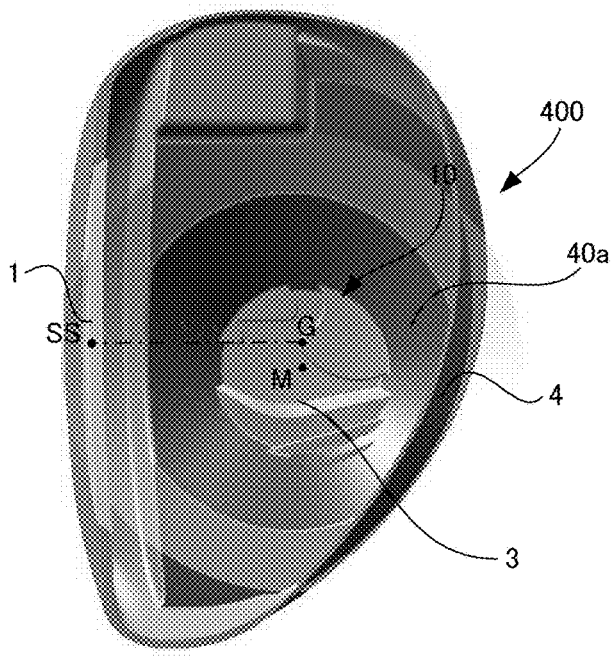
FIG. 13 is a diagram showing the golf club head according to the fourth embodiment with an upper portion removed, as viewed from above.
Figure 14:
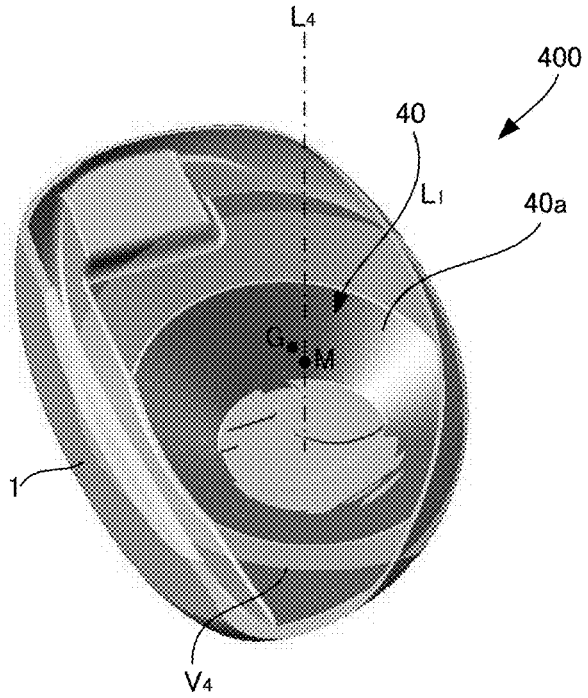
FIG. 14 is a diagram showing the golf club head according to the fourth embodiment with the upper portion removed, as viewed from obliquely above.

FIG. 12 is a lateral cross-sectional view of the head 400, and FIG. 13 is a diagram showing the head 400 as viewed from above, with the upper portion removed in order to view the thick-wall structure in the head body 6. FIG. 14 is a diagram of the head 400 in FIG. 13, as viewed from obliquely above. In the fourth embodiment, the horizontal moment of inertia around the center of gravity G of the head 400 is optimized using the thick-wall structure in the head body 6.

Specifically, in the fourth embodiment as well, a thick portion 40 is formed on the sole portion 3 in the head body 6, as shown in FIG. 12. As shown in FIG. 13, this thick portion 40 extends in the shape of a ring centered about the reference point M in the vicinity of the center of gravity G in a plan view. Also, as shown in FIG. 14, the thick portion 40 has a side surface 40*a* (outer surface) that extends along a virtual curved surface that constitutes part of the outer surface of a virtual cone $V_4$ in a three-dimensional view, and the thick portion 40 is located outward of the virtual cone $V_4$. The virtual cone $V_4$ is a cone having a central axis $L_4$ that is a straight line passing through the reference point M, and the central axis $L_4$ extends in the top-sole direction. Also, the virtual cone $V_4$ is an inverted cone whose apex faces downward. Note that in accordance with the design target value of the depth of the center of gravity, the thick portion 40 may be arranged on either the back side or the face side relative to the center of gravity G. The reference point M and the center of gravity G are at the same position in the top-sole direction.

The reference point M that determines the position of the aforementioned virtual cone $V_4$ is preferably located in a range of 25.0 mm from the center of gravity G, and more preferably is located in a range of 10.0 mm from the center of gravity G. Also, the reference point M is more preferably located in a range of 7.0 mm from the center of gravity G, further preferably located in a range of 5.0 mm from the center of gravity G, further preferably located in a range of 2.0 mm from the center of gravity G, further preferably located in a range of 1.0 mm from the center of gravity G, and further preferably located in a range of 0.5 mm from the center of gravity G. In particular, the deviation between the reference point M and the center of gravity G in the face-back direction is preferably 2.0 mm or less, and more preferably 1.0 mm or less. The smaller the distance between the reference point M and the center of gravity G is, the more uniformly the thick portion 40, which is arranged centered about the reference point M, is arranged around the center of gravity G, and the greater the expected increase in the horizontal moment of inertia is.

As described above, in the present embodiment, the thick portion 40 on the inner side of the head body 6 is configured to be located outward of the virtual cone $V_4$ and have an outer surface that extends along the virtual cone $V_4$. As a result, the weight is distributed in a balanced manner at positions distant from the central axis $L_4$ that passes through the reference point M in the vicinity of the center of gravity G and extends in the vertical direction, and it is possible to increase the horizontal moment of inertia of the head 400.

6. Variations

Although embodiments of the present invention have been described above, the present invention is not limited to these embodiments, and various modifications can be made without departing from the gist of the invention. The following are examples of modifications that can be made. Any combination of the features of the following variations can be used as appropriate.

6-1

In the above embodiments, the virtual curved surface for determining the arrangement of the thick portions 10 to 40 is a curved surface that extends along the outer surface of a cylinder, a sphere, or a cone, but it may be a curved surface that extends along the outer surface of an ellipsoid, an elliptical cylinder, or an elliptical cone. In this case, the ellipticity of the ellipsoid, and the bottom surfaces of the elliptical cylinder and the elliptical cone can be set appropriately so as to obtain a desired moment of inertia for the head, but the ratio of the long side to the short side is preferably 2 or less, more preferably 1.5 or less, further preferably 1.3 or less, further preferably 1.2 or less, and further preferably 1.1 or less. Also, the virtual curved surface can be another curved surface that defines a recessed curved surface that is recessed toward the reference point M. In this case, the above-described preferable value ranges in the case of the ellipsoid and the like can be applied to the extent of the ellipticity of the recessed curved surface as well. Note that the distance between the reference point M and the point on the recessed curved surface farthest from the reference point M is considered to be the long side, and the distance between the reference point M and the point on the recessed curved surface closest to the reference point M is considered to be the short side.

6-2

The thick portions 10 to 40 are not limited to be formed on the sole portion 3, and can be formed at any position on an inner wall surface of the hollow structure body of the head 100, excluding the rear surface of the face surface. Accordingly, instead of or in addition to the inner wall surface of the sole portion 3, a thick portion having an outer surface that extends along a virtual curved surface can also be formed on an inner wall surface of the crown portion 2, the side portion 4, or the like.

6-3

The axis of the virtual cylinder or the virtual cone for defining the virtual curved surface is not limited to extending along the vertical direction or the horizontal direction, and can be set to any direction in which the moment of inertia of the head is to be increased.

Working Example

The following describes a working example of the present invention. Note that the present invention is not limited to the following working example.

Figure 15A:
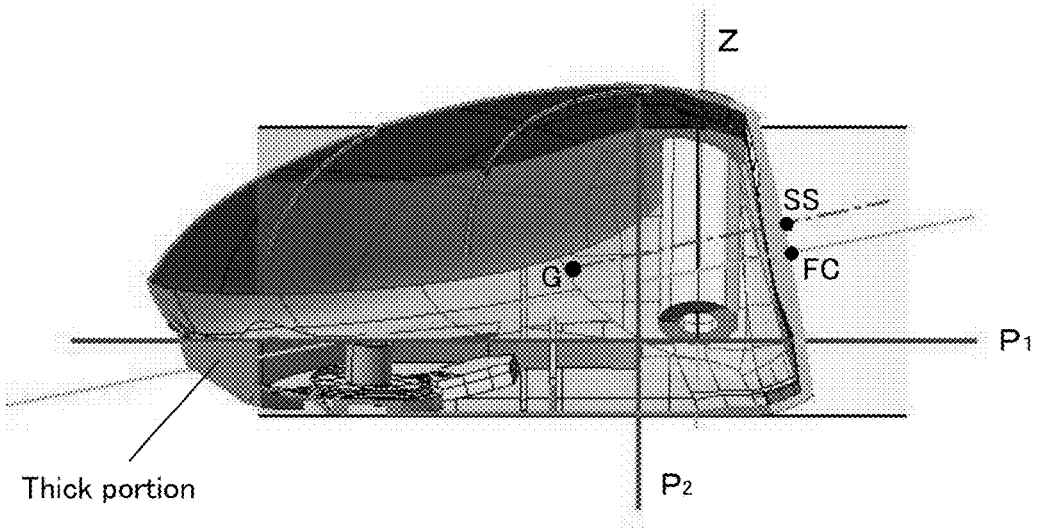
FIG. 15A is a transparent cross-sectional view of a golf club head according to a working example.
Figure 15B:
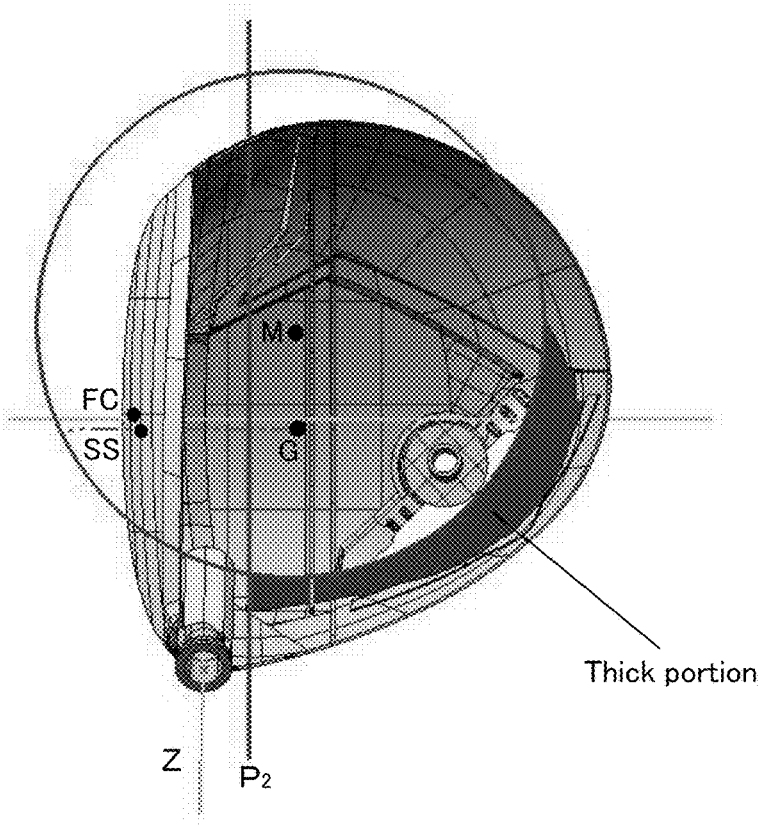
FIG. 15B is a transparent plan view of the golf club head according to the working example.
Figure 16A:
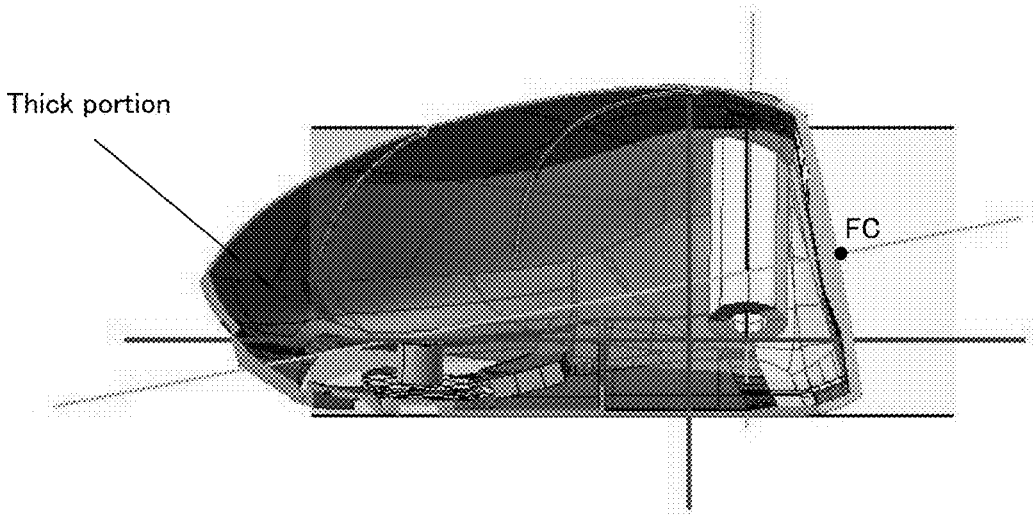
FIG. 16A is a transparent cross-sectional view of a golf club head according to a comparative example.
Figure 16B:
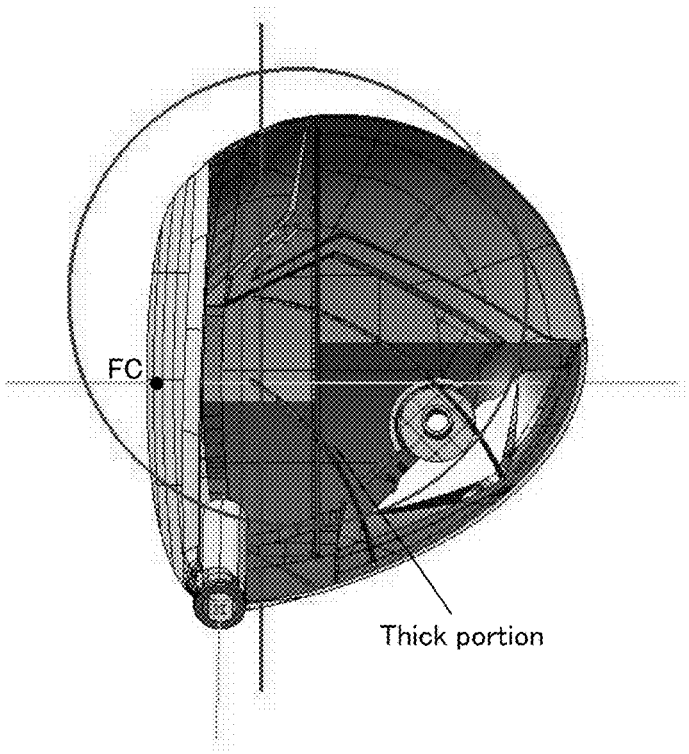
FIG. 16B is a transparent plan view of the golf club head according to the comparative example.

Here, the golf club head shown in FIGS. 15A and 1 SB was designed as a working example, the golf club head shown in FIGS. 16 A and 16B was designed as a comparative example, and the horizontal moment of inertia around the center of gravity G was calculated through simulation. Note that a face center FC, which is the geometrical center of the face surface, is shown in FIGS. 15A and 15B and 16A and 16B for reference. In the working example, a weight of 15 g was arranged on the heel side and the back side, outward of a virtual cylinder extending in the vertical direction; and in the comparative example, a weight of 15 g was arranged on the heel side and the back side, inward and outward of a virtual cylinder. Also, in the case of the working example, simulation was performed for five cases in which the distance between the center of gravity G and the reference point M of the virtual cylinder in the toe-heel direction was 2 mm, 5 mm, 10 mm, 22.5 mm, and 25 mm. There was substantially no deviation between the center of gravity G and the reference point M in the top-sole direction and the face-back direction.

The following table shows the horizontal moment of inertia around the center of gravity G in the above-described working example and comparative example, and it was confirmed that the horizontal moment of inertia is increased in the working example. Also, it was confirmed that in the working example, the smaller the distance between the center of gravity G and the reference point M is, the greater the increase in the horizontal moment of inertia is.

TABLE 1

| | Working Example | | | | | Comparative Example |
|---|---|---|---|---|---|---|
| Offset dimension | 2 mm | 5 mm | 10 mm | 22.5 mm | 25 mm | |
| Horizontal moment of inertia [g · cm$^2$] | 4260 | 4240 | 4230 | 4160 | 4140 | 4130 |

REFERENCE SIGNS LIST

1 Face portion
2 Crown portion
3 Sole portion
4 Side portion
6 Head body
10, 20, 30, 40 Thick portion
100, 200, 300, 400 Wood golf club head
G Center of gravity
M Reference point
$L_1$, $L_3$, $L_4$ Central axis
$P_2$ Depth plane
$V_1$, $V_4$ Virtual cylinder
$V_2$ Virtual sphere
$V_3$ Virtual cone

The invention claimed is:

1. A wood golf club head comprising:
a hollow structure body having a face surface for hitting a ball, wherein
the hollow structure body has an inner surface and a thick portion in a predetermined region on the inner surface excluding a rear surface of the face surface,
the thick portion is located outward of a virtual curved surface so as to be in substantial continuous surface contact with the virtual curved surface and has an outer surface extending along the virtual curved surface,
a predetermined reference point is located inside the hollow structure body,
a distance between the reference point and the golf club head center of gravity is 0.0 mm and 5.0 mm,
the virtual curved surface is defined by a part of the outer surface of the thick portion, and
the virtual curved surface is (a) a curved surface that defines a part of an outer surface of a virtual sphere centered about the reference point or (b) a curved surface that defines a part of an outer surface of a virtual cylinder or a virtual cone having a central axis that is a straight line passing through the reference point.

2. The wood golf club head according to claim 1, wherein the deviation between the reference point and the center of gravity of the golf club head is 0.0 mm or more and 2.0 mm or less.

3. The wood golf club head according to claim 1, wherein
the hollow structure body has a crown portion, a sole portion, and a side portion, and
the thick portion is provided on the sole portion.

4. The wood golf club head according to claim 2, wherein
the hollow structure body has a crown portion, a sole portion, and a side portion, and
the thick portion is provided on the sole portion.

5. The wood golf club head according to claim 1, wherein the thick portion is located on a back side relative to a depth plane that is perpendicular to a horizontal plane, the depth plane includes the golf club head center of gravity, and the depth plane extends in a toe-heel direction.

6. The wood golf club head according to claim 2, wherein the thick portion is located on a back side relative to a depth plane that is perpendicular to a horizontal plane, the depth plane includes the golf club head center of gravity, and the depth plane extends in a toe-heel direction.

7. The wood golf club head according to claim 5, wherein the thick portion further has an outer surface that extends along the depth plane.

8. The wood golf club head according to claim 1, wherein the thick portion is provided at least a position on a toe side of the inner surface of the hollow structure body.

9. The wood golf club head according to claim 1, wherein the virtual curved surface is (a) a curved surface that defines a part of an outer surface of a virtual sphere centered about the reference point.

10. The wood golf club head according to claim 1, wherein the virtual curved surface is (b) a curved surface that defines a part of an outer surface of a virtual cylinder or a virtual cone having a central axis that is a straight line passing through the reference point.

11. A wood golf club head comprising:

a hollow structure body having a face surface for hitting a ball, wherein the hollow structure body has an inner surface and a thick portion in a predetermined region on the inner surface excluding a rear surface of the face surface, the thick portion is located outward of a virtual curved surface so as to be in substantial continuous surface contact with the virtual curved surface and has an outer surface extending along the virtual curved surface, a predetermined reference point is located inside the hollow structure body, a distance between the reference point and the golf club head center of gravity in the face-back direction is 0.0 mm and 2.0 mm, the virtual curved surface is defined by a part of the outer surface of the thick portion, and the virtual curved surface is (a) a curved surface that defines a part of an outer surface of a virtual sphere centered about the reference point or (b) a curved surface that defines a part of an outer surface of a virtual cylinder or a virtual cone having a central axis that is a straight line passing through the reference point.

12. The wood golf club head according to claim 1, wherein the thick portion is located outward of the virtual curved surface so as to be in substantial continuous surface contact with the virtual curved surface and has the outer surface extending along the virtual curved surface, thereby providing a weight distribution at positions spaced equally and evenly apart from the reference point.

13. The wood golf club head according to claim 11, wherein the thick portion is located outward of the virtual curved surface so as to be in substantial continuous surface contact with the virtual curved surface and has the outer surface extending along the virtual curved surface, thereby providing a weight distribution at positions spaced equally and evenly apart from the reference point.

* * * * *